United States Patent [19]

Grabill et al.

[11] Patent Number: 4,910,818

[45] Date of Patent: Mar. 27, 1990

[54] LEG POSITIONING ASSEMBLY

[76] Inventors: Robert Grabill, 6787 Bayshore Dr., Lantana, Fla. 33462; Graham Whitfield, 235 Queens La., Palm Beach, Fla. 33480

[21] Appl. No.: 324,394

[22] Filed: Mar. 16, 1989

[51] Int. Cl.[4] ..... A47C 20/02

[52] U.S. Cl. ..... 5/443; 5/494; 2/DIG. 6; 128/80 A; 297/439

[58] Field of Search ..... 5/443, 444, 431, 434, 5/436, 437, 494; 128/80 A, 80 R, 882; 269/328; 297/439; 2/DIG. 6

[56] References Cited

U.S. PATENT DOCUMENTS

| | | | |
|---|---|---|---|
| 395,043 | 0/1888 | Doremus | 5/437 |
| 462,402 | 11/1986 | Hofstetter | 5/431 |
| 1,194,200 | 0/1916 | Lowder . | |
| 2,839,766 | 6/1958 | Hull | 5/431 |
| 3,162,486 | 0/1963 | Emery . | |
| 3,284,817 | 4/1966 | Landwirth | 128/80 R |
| 3,339,544 | 9/1967 | Kravitz | 5/443 |
| 3,604,023 | 0/1971 | Lynch . | |
| 3,734,623 | 0/1963 | Rector . | |
| 3,965,508 | 6/1976 | Hunter | 5/451 |
| 4,177,806 | 12/1979 | Griffin | 2/22 |
| 4,275,472 | 6/1981 | Erck | 5/443 |
| 4,327,714 | 8/1982 | Spann | 5/443 |
| 4,454,869 | 6/1984 | Byler | 128/69 |
| 4,550,459 | 11/1985 | Endel et al. | 5/436 |
| 4,574,412 | 3/1986 | Smith | 5/436 |
| 4,584,730 | 4/1986 | Rajan | 5/431 |
| 4,683,601 | 8/1987 | Lagin | 5/431 |
| 4,685,163 | 8/1987 | Quillen et al. | 5/431 |
| 4,706,302 | 11/1987 | Padfield et al. | 2/22 |
| 4,736,477 | 4/1988 | Moore | 5/443 |
| 4,805,605 | 2/1989 | Glassman | 128/80 A |

FOREIGN PATENT DOCUMENTS

| | | | |
|---|---|---|---|
| 2551347 | 9/1983 | France | 5/441 |

*Primary Examiner*—Alexander Grosz

*Attorney, Agent, or Firm*—Steele, Gould & Fried

[57] ABSTRACT

A leg positioning assembly includes a pillow adapted to separate the knees of a patient and to maintain the knees in flexion. The pillow is preferably substantially three-lobed, with two lobes forming a base portion and a third lobe forming a portion which separates the knees of the patient. A raised portion on each of the lobes forming the base portion can be provided to support and flex the legs at the knees. Fastening structure can be provided to secure the pillow to a patient support. Other fastening structure can be provided to secure the pillow to the legs of the patient.

12 Claims, 3 Drawing Sheets

FIG. 1
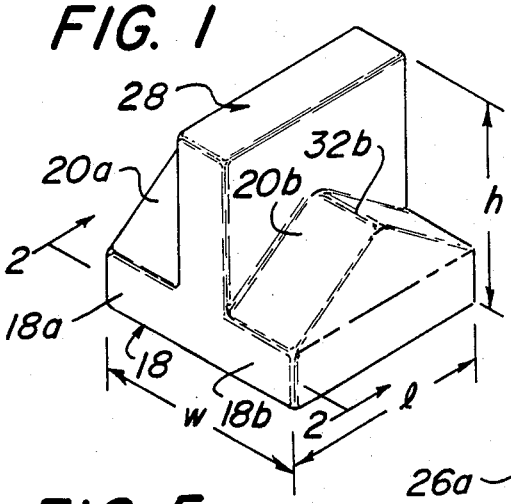
FIG. 2
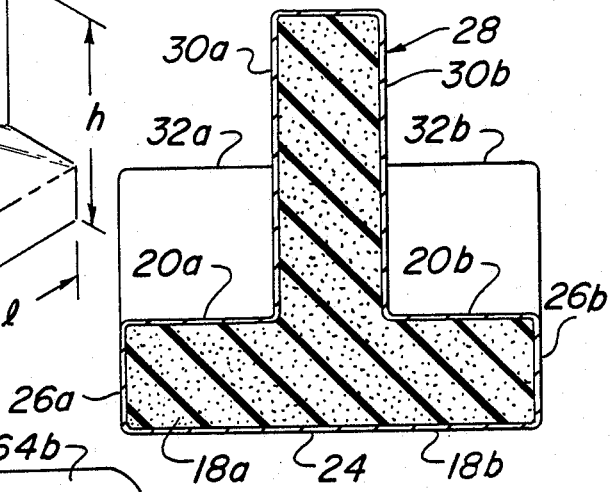
FIG. 5
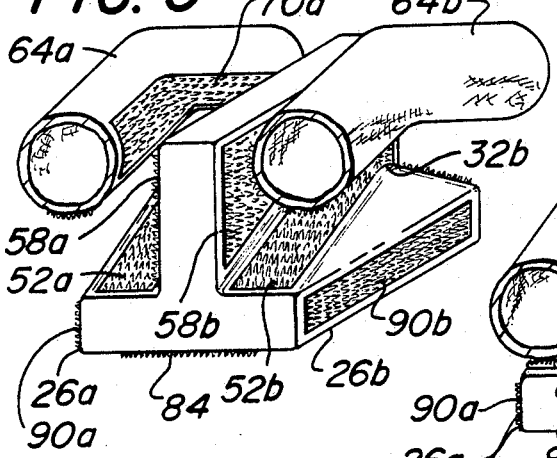
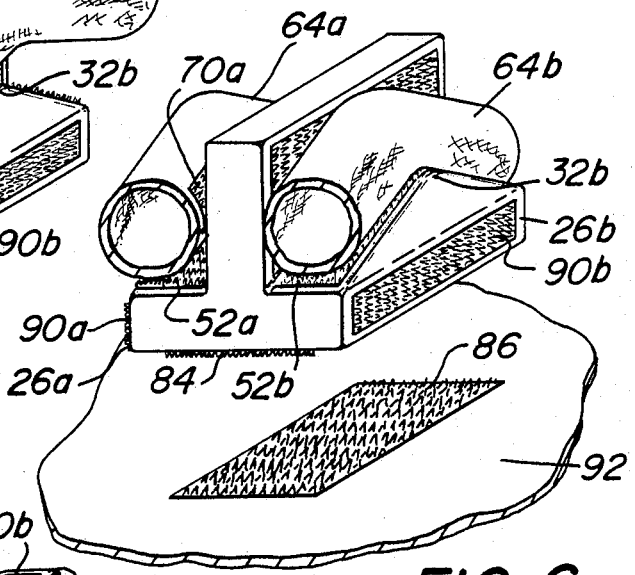
FIG. 6
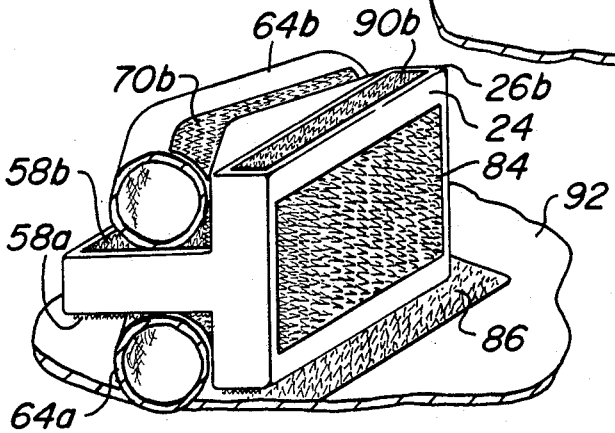
FIG. 7

FIG. 8
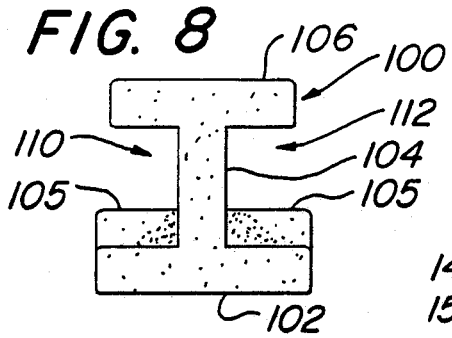
FIG. 10
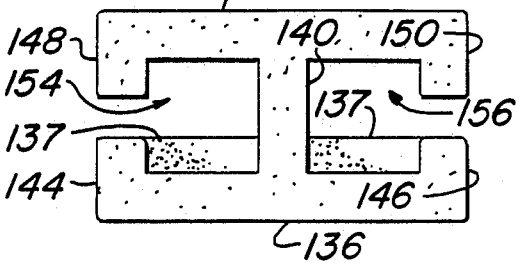
FIG. 9
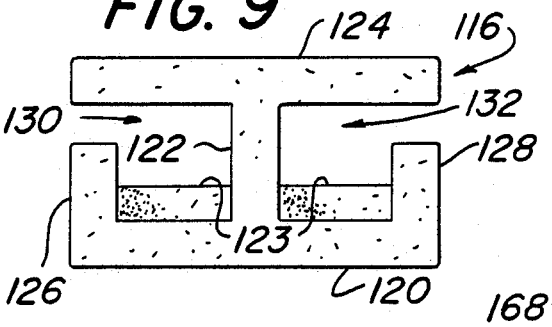
FIG. 11
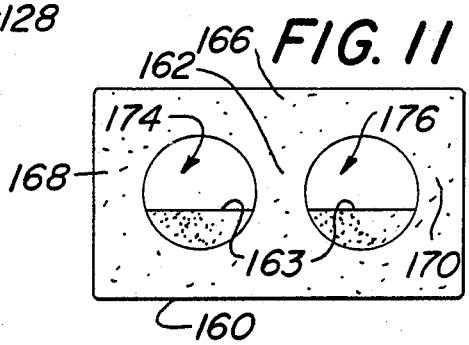
FIG. 12
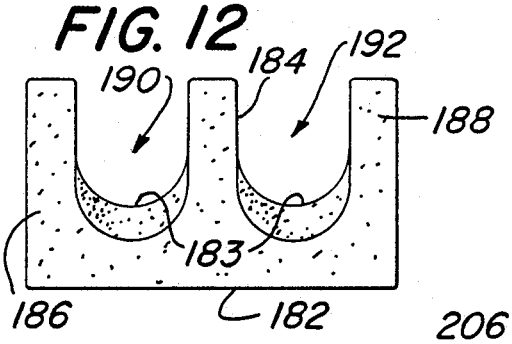
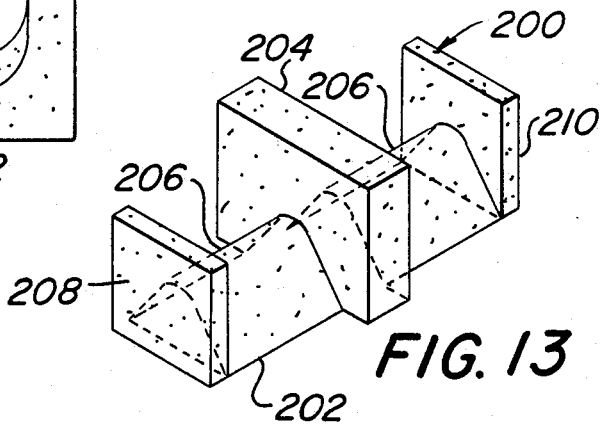
FIG. 13

LEG POSITIONING ASSEMBLY

BACKGROUND OF THE INVENTION

1. Field of the Invention

This invention relates generally to medical apparatus, and more particularly to apparatus for positioning the legs the patient in flexion and with the knees apart.

2. Description of the Prior Art

It is desirable when resting in either the supine position (on the back) or the lateral decubitus position (on the side) to flex the hips and knees so as to relieve stress on the lower back. This is particularly true for individuals suffering from low back pain, arthritic disorders of the hips or knees, discogenic disease of the lumbar spine, sacral decubiti, or any other medical condition the treatment of which includes the flexing of the hips and knees. A conventional pillow is usually placed under the knees or legs when resting in the supine position, which pillow is transferred to a position between the knees when the patient turns to rest on the side. The pillow frequently becomes displaced during sleep, especially as the patient moves and turns.

The relevant art includes cushions, pillows and supports for positioning and supporting the legs of a patient. The art has failed to provide a simple, yet effective, positioning apparatus and assembly which will maintain the knees of a patient in a spaced and flexed condition to provide optimum comfort and relief from lower back stress and the accompanying pain. The art has also failed to provide such an apparatus which will prevent turning movement of the legs of the patient where such movement is not in the best interests of the comfort and recovery of the patient.

SUMMARY OF THE INVENTION

It is an object of the invention to provide an apparatus for separating and flexing the knees of a patient lying in either the supine position or the lateral decubitus position.

It is another object of the invention to relieve stress and pain of the lower back during bed rest.

It is yet another object of the invention to provide an apparatus which will relieve pain in individuals who suffer from low back pain, arthritic disorders of the hips or knees, discogenic disease of the lumbar spine, sacral decubiti, or other medical conditions in which pain can be relieved by flexing the hips add knees.

It is still another object of the invention to provide an apparatus which will securely maintain the knees of a patient in a flexed and separated position.

It is yet another object of the invention to provide a means for separating and flexing the legs of a patient which does not have to be repositioned each time the patient turns.

It is another object of the invention to provide an apparatus which will secure a patient to a patient support with the knees in a flexed and separated position, and which will maintain the legs in this position during sleep.

These and other objects are accomplished by an assembly which includes a pillow adapted to flex and separate the knees of an individual during rest on a bed or patient support. The pillow includes two lobes forming a base having a top portion and a bottom portion. A third lobe extends upwardly from the base so as to provide a three-lobed construction forming, with the base, leg receiving grooves or channels. The knees are positioned on each side of the third lobe, in the channels, with the legs bent at the knees and with the thighs and calves draped over respective longitudinal ends of the base so that the knees will be separated and maintained in the flexed condition. A raised portion can be provided on each lobe of the base to support and flex the knees of the patient.

The width of the base should be in excess of the combined widths of the legs of the patient. The length of the base is preferably at least equal to its width, which will assist the patient in maintaining the flexed leg condition by allowing for the thighs and calves of the patient to drape over longitudinal ends of the pillow.

The positioning pillow of the invention will remain between the legs of the patient even as the individual turns during sleep. The three-lobed construction of the invention provides that one of the lobes is always in front of one of the legs as the patient turns from the back to the side, or from the side to the back. One of the legs will engage the upstanding third lobe as the individual turns from the supine position to either lateral side, to cause the pillow to turn with the patient. One of the lobes of the base will be engaged by the back of a leg as the individual turns from the side to the supine position. The positioning pillow will, therefore, follow the turns of the individual during the course of sleep and will not dislodge from its position between the knees.

It is desirable in some instances to prevent a patient from turning during sleep, particularly where such turns will aggravate an existing ailment or injury. The invention contemplates a fastening means by which the positioning pillow can be detachably secured to a patient support so as to maintain the knees in the desired flexed, separated position. The fastening structure is preferably a hook and loop fastener, which is provided at least on the bottom portion of the base. A cooperating hook and loop fastener is provided on the bed or patient support. The cooperating hook and loop fastener can be conveniently provided on a bed covering, which can be secured to the bed or patient support by any suitable methods. The positioning assembly will thereby secure the pillow and the legs of the patient to the patient in the desired flexed, separated configuration, and will not allow the patient to turn during sleep.

It is desirable to also provide fastening structure on side portions of the base, which fastening structure can be used to fix the positioning pillow and the legs of the patient in a sideways position relative to the patient support. The legs of the patient can thereby also be maintained in the flexed, separated configuration when the patient is lying in the lateral decubitus position. Such fastening structure can also be a hook and loop fastener adapted to engage a cooperating hook and loop fastener on the bed covering.

Fastening structure is preferably provided to secure the legs of the patient to the pillow. The fastening structure is fixed to the pillow and engages the legs of the patient to prevent the legs from moving from their position in the receiving channels. The fastening structure preferably includes a hook and loop type fastener for adjustable engagement of the legs. The fastener could be provided on suitable straps. A preferred engagement structure provides hook and loop fastening structure on the leg portions of bed clothes for the patient. Cooperating fastening structure is provided on the pillow in the receiving channels. The fastening structure in the receiving channels engages in a cooperative fashion the fastening structure on the leg portions of the bed clothes so as to secure the legs of the patient to the pillow in the flexed, separated position.

The positioning pillow of the invention is capable of taking several alternative forms. Upstanding leg-containment portions can extend upwardly from the lateral sides of the base to prevent the legs of the patient from moving laterally off of the base. The upstanding third lobe can have laterally extending top flange portions which, with the third lobe and the base, form a substantially U-shaped groove for each of the patient's legs to further prevent dislodgement from the pillow. Downwardly depending portions can be provided at the lateral sides of the top flange portions. The downwardly depending portions extend toward the base such that the legs of the patient are substantially encircled by the pillow.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 1 is a perspective view of a positioning pillow according to the invention.

FIG. 2 is a cross-section taken along line 2—2 in FIG. 1.

FIG. 5 an exploded perspective view of a positioning assembly according to the invention.

FIG. 6 an exploded perspective view of a further embodiment of a positioning assembly according to the invention.

FIG. 7 is a perspective view of the positioning assembly of FIG. 6 in an alternative configuration.

FIG. 8 is a front elevation of a first alternative positioning pillow.

FIG. 9 is a front elevation of a second alternative positioning pillow.

FIG. 10 is a front elevation of a third alternative positioning pillow.

FIG. 11 a front elevation of a fourth alternative pillow.

FIG. 12 is a front elevation of a fifth alternative positioning pillow.

FIG. 13 is a perspective view of a sixth alternative positioning pillow.

DETAILED DESCRIPTION OF THE PREFERRED EMBODIMENTS

Figure 3:
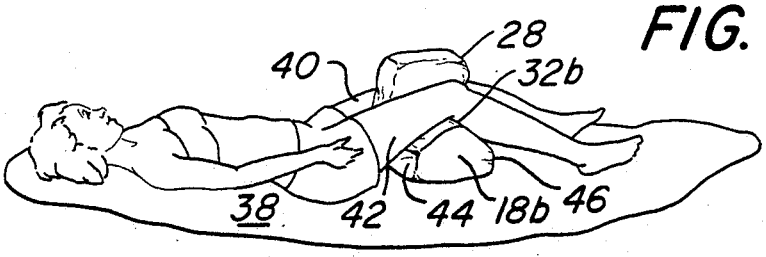
FIG. 3 is a perspective view of a patient using the positioning pillow of the invention when resting in the supine position.

A positioning pillow according to the invention is depicted in FIGS. 1–2. The pillow is adapted to maintain the legs of the patient in flexion, especially at the knees, and also to separate the legs from one another. The pillow includes a base portion 18 comprised of first and second lobes **18*a*, 18*b*, respectively. The base 18 includes a top portion 20 and a bottom portion 24. The base 18 can also have lateral side portions 26*a*, 26*b*. The pillow has an upstanding third lobe portion 28 which has lateral faces 30*a*, 30*b*. The third lobe 28 is substantially centrally located on the top portion 20 of the base 18, and substantially divides the top portion 20 into a first lateral portion 20*a* and a second lateral portion 20*b*. The first lateral portion 20*a* and second lateral portion 20*b* together define the top portion 20. The included spaces between the top portion 20*a* and the lateral face 30*a*, and between the top portion 20*b* and the lateral face 30*b*, form leg receiving channels for the legs of the patient. The top portions 20*a*, 20*b* of the base 18 preferably include raised portions 32*a*, 32*b***, respectively, which help to support and flex the legs at the knees.

Figure 4:
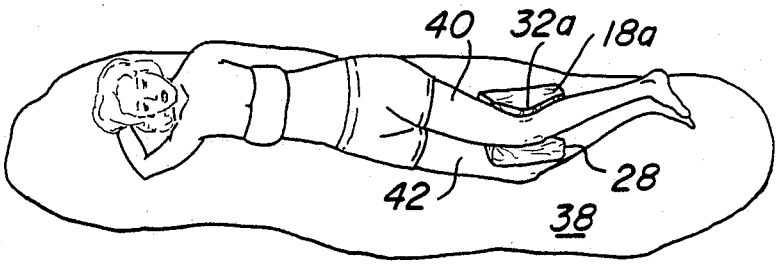
FIG. 4 is a perspective view of a patient using the positioning pillow of the invention when resting in the lateral decubitus position.

The operation of the pillow is shown in FIGS. 3–4. In FIG. 3 there is shown an individual lying in the supine position on a support surface 38 with left leg 40 and a right leg 42 positioned on either side of the third lobe 28 of the pillow with the knees in the desired flexed, separated position. The legs are flexed at the knees and supported by the raised portions **32*a*, 32*b***.

The width "w" of the pillow, as indicated in FIG. 1, is at least equal to the combined width of the legs of the user, and preferably is in excess of this width. The length "l" of the pillow is preferably at least equal in dimension to the width "w", such that the thigh and calf of each leg will drape over the opposing longitudinal edges 44, 46 of the lobes **18*a*, 18*b* of the base 18**. The length "l" should also be somewhat less than the length from the thighs to the calves of the patient, when the legs are straight, to allow the legs to flex in the manner depicted in FIGS. 3–4. This will assist the user in attaining the proper flexion in the legs. The height "h" of the upstanding third lobe of the pillow is preferably at least sufficient to extend completely between the legs a distance such that the legs can be maintained in the desired flexed position.

Use of the pillow when lying in the lateral decubitus position is shown in FIG. 4. The individual is shown lying on the right side, with the third lobe 28 of the pillow positioned between the legs 40, 42. The right leg 42 rests on the support surface 38. The left leg 40 is substantially on top of the right leg 42, and rests comfortably on the third lobe 28. Both legs are flexed around the raised portions **32*a*, 32*b*. The base 18** extends from the thigh to the calf of the patient, such that the legs conform to the flexed, separated position while the individual is lying on the side.

The first and second lobes **18*a* and 18*b* of the base 18 form with the upstanding third lobe portion 28 a three-lobed construction which substantially prevents dislodgement of the pillow from its position between the knees of the patient, even as the individual turns during sleep. Each leg of the patient is adjacent a lobe of the pillow in either direction of turn. Should the patient turn from the supine position of FIG. 3 to the lateral decubitus position of FIG. 4, the leg 40 will contact the third lobe 28 to turn the pillow on its side as the individual turns. Should the individual turn from the lateral decubitus position of FIG. 4 to the supine position of FIG. 3, the back of the leg 40 would engage the first lobe 18*a*** to turn the pillow with the patient. The same principles would hold for turns to and from a position lying on the left side.

Dislodgement of the positioning pillow from the desired position between the legs can be further prevented by the provision of fastening means adapted to engage the pillow to the legs of the patient. The fastening means can be straps or other suitable structure. A preferred fastening means is shown in FIGS. 5–7. Hook and loop fasteners **52*a*, 52*b* are provided on the top surfaces 20*a*, 20*b*, respectively. Alternative or additional hook and loop fasteners 58*a*, 58*b* can be provided on the lateral sides 30*a*, 30*b*, respectively, of the third lobe 28. Structure attachable to the legs of the patient has cooperating fasteners. The invention preferably provides bed clothes for the patient such as pajamas with leg portions 64***a*, 64*b* broken away in FIGS. 5–7 to indicate indefinite length. Hook and loop fastening means 70*a*, 70*b* are provided on the leg portion 64*a*, 64*b*, respectively, of the bed clothes and are adapted to cooperate with the hook and loop fasteners on the pillow to secure the bed clothes, and thus the legs of the patient, to the pillow in the proper position.

Some patients with particular ailments and injuries should not move without special care or assistance. It is desirable to secure these patients against movement during sleep. This can be accomplished by the provision of a suitable fastening means adapted to secure the pillow to the bed or patient support. A preferred fastening means is a hook and loop fastener. A first hook and loop fastener 84 can be provided on the bottom portion 24 of the pillow. A second hook and loop fastener 86 can be secured to the bed or patient support such that the pillow and the patient will be secure to the bed or patient support. It is also possible to provide hook and loop fasteners 90*a*, 90*b* on each respective side portion 26*a*, 26*b* of the base 18. The pillow 18 can be thereby secured on either lateral side to the cooperating fastener 86 on the patient support (FIG. 7), and the patient can be secured against movement in the lateral decubitus position.

The second fastener 86 can be secured directly to the bed or patient support, but is preferably detachable from the bed or patient support. The fastener 86 therefore preferably attached to a bed sheet 92, which can then be secured to any standard bed or patient support by known methods and removed and washed whenever necessary.

The pillow of the invention can be manufactured from any suitable material, but preferably is manufactured from a firm cushion material which will be comfortable, yet rigid enough to support the wight of the user in the afore-mentioned manner. One such suitable material is polyurethane foam. A wear resistant, washable outer cover can also be provided.

The invention is capable of taking several alternative forms, particularly in the particular design of the positioning pillow. Alternative embodiments are depicted in FIGS. 8–13. In FIG. 8 there is shown a first alternative positioning pillow 100 with a base 102 and a third lobe portion 104. Each lobe of the base 102 is provided with a raised portion 105 adapted to flex and support the legs. A top flange 106 is provided at a side portion of the third lobe 104 distal to the base 102. The top flange 106 extends laterally outward and substantially parallel to the base 102 to either side of the third lobe 104, and forms with the base 102 add third lobe 104 substantially U-shaped leg receiving channels 110, 112.

A second alternative positioning pillow 116 (FIG. 9) has a base portion 120 and a third lobe 122. A raised portion 123 is provided on each lobe of the base to flex and support the legs. A top flange 124 extends laterally outward from an end o the third lobe 122 distal to the base 120. Upstanding lateral flanges 126, 128 are provided on the lateral edges of the base 120 to form leg-receiving channels 130, 132 which substantially encircle the legs of the patient.

A third alternative positioning pillow is shown in FIG. 10 which includes a base portion 136 and a third lobe portion 140. A raised portion 137 is provided on each lobe of the base 136 to flex and support the legs. A top flange 142 extends laterally outward from a distal edge of the third lobe 140 and is substantially parallel to the base 136. Upstanding lateral flanges 144, 146 are provided on lateral side edges of the base 136 to partially contain the legs of the user. Depending flanges 148, 150 extend downwardly from lateral sides of the top flange 142 so as to substantially abut the upstanding flanges 144, 146. The configuration provides channels 154, 156 for containment of the legs of the patient in the proper flexed, separate position.

A fourth alternative embodiment is depicted in FIG. 11. In this embodiment, the positioning pillow includes a base portion 160 and an upstanding portion 162. Each lobe of the base portion 160 is provided with a raised portion 163 to flex and support the legs. A top flange 166 is joined to the base portion 160 at side edges 168, 170 so as to form completely enclosed channels 174, 176 for the legs of the patient.

A fifth alternative embodiment (FIG. 12) is provided with a base portion 182 and a third lobe portion 184. Each lobe of the base 182 includes a raised portion 183 adapted to flex and support the legs. Upstanding side flanges 186, 188 are provided on lateral sides of the base 182 and extend upwardly to substantially the height of the third lobe 184. In this manner, substantially U-shaped receiving channels 190, 192 are formed to receive and maintain the legs of the user in the flexed, separated position.

A sixth alternative embodiment of the invention is depicted in FIG. 13. A positioning pillow 200 has a base portion 002 and an upstanding third lobe portion 204. Each lobe of the base portion 202 is provided with a raised portion 206 over which is positioned the back of the knee, so as to flex and support the legs in the desired flexed, separated position during sleep. Upstanding flange portions 208, 210 can be provided on the lateral sides of the base 202 to form leg-receiving channels for the legs.

It is apparent from the foregoing description that the invention is capable of taking several alternative forms without departing from the spirit or essential attributes thereof and, accordingly, reference should be made to the following claims, rather than to the foregoing specification, as indicating the scope of the invention.

I claim:

1. An assembly for positioning the legs of a patient in flexion and with the knees separated, whether the patient is lying in either of the supine or lateral decubitus positions, comprising:

a pillow adapted to be secured between the legs of the patient and to maintain the legs of the patient in said flexed and separated position, the pillow having at least one fastening means;

bed clothes, the bed clothes having leg portions with fastening means adapted to engage said fastening means on said pillow to secure the legs of the patient to said pillow; and, a bed covering, the bed covering having a fastening means, said fastening means on said bed covering being adapted to engage said fastening means on said pillow, whereby said bed covering can be engaged to a bed or patient support, said pillow can be engaged to said bed covering, and the legs of the patient can be engaged to said pillow to secure the legs of the patient against movement.

2. The assembly of claim 1, wherein said pillow comprises three lobes.

3. The assembly of claim 2, wherein said three-lobed pillow comprises a base having first and second lobes, and a third lobe portion extending from the base and forming, with the first and second lobes, leg-receiving channels adapted to retain the legs of the patient apart and in flexion.

4. The assembly of claim 3, wherein said fastening means comprises a hook and loop fastener.

5. The assembly of claim 3, wherein the length of the base is at least equal to the width.

6. The assembly of claim 5, wherein the length of the base is less than the length of the patient's straight leg between the thighs and the calves.

7. The assembly of claim 3, wherein said base comprises lateral side portions, and further comprising leg-containment portions extending upwardly from said lateral side portions to form with said third lobe and said base said leg-receiving channels.

8. The assembly of claim 3, further comprising top flange portions extending laterally outward from a portion of the third lobe distal to the base, said top flanges being substantially parallel to said base to further define said leg-receiving channels.

9. The positioning pillow of claim 8, wherein said top flange portions have lateral downwardly-depending flange portions, the base portion further comprising lateral side portions, and leg-containment portions extending upwardly from said lateral side portions, whereby the leg-receiving channels of said pillow are substantially squared-off, C-shaped in cross-section.

10. The assembly of claim 8, wherein said depending flanges and upwardly-extending flanges are joined together, said joined portions forming enclosed leg-receiving channel means.

11. The assembly of claim 3, wherein said base further comprises raised portions on the base adapted to flex and support the legs at the knees.

12. The assembly of claim 1, wherein said fastening means comprises a hook and loop fastener.

* * * * *